US010378310B2

(12) United States Patent
Eriksen

(10) Patent No.: US 10,378,310 B2
(45) Date of Patent: Aug. 13, 2019

(54) DRILLING FLOW CONTROL TOOL

(71) Applicant: Schlumberger Technology Corporation, Sugar Land, TX (US)

(72) Inventor: Erik P. Eriksen, Calgary (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 91 days.

(21) Appl. No.: 15/319,199

(22) PCT Filed: Jun. 24, 2015

(86) PCT No.: PCT/US2015/037291

§ 371 (c)(1),
(2) Date: Dec. 15, 2016

(87) PCT Pub. No.: WO2015/200397

PCT Pub. Date: Dec. 30, 2015

(65) Prior Publication Data

US 2017/0130561 A1 May 11, 2017

Related U.S. Application Data

(60) Provisional application No. 62/017,175, filed on Jun. 25, 2014.

(51) Int. Cl.
*E21B 7/20* (2006.01)
*E21B 21/10* (2006.01)
(Continued)

(52) U.S. Cl.
CPC ..... *E21B 34/10* (2013.01); *E21B 7/20* (2013.01); *E21B 21/103* (2013.01);
(Continued)

(58) Field of Classification Search
CPC ..... E21B 21/103; E21B 7/20; E21B 33/126; E21B 33/14; E21B 34/10; E21B 34/14; E21B 34/103; E21B 2034/007
See application file for complete search history.

(56) References Cited

U.S. PATENT DOCUMENTS 2,946,565 A * 7/1960 Williams ..... E21B 17/18 166/106
3,010,518 A * 11/1961 Harmon ..... E21B 33/14 166/183

(Continued)

OTHER PUBLICATIONS

International Preliminary Report on Patentability issued in International Application No. PCT/US2015/037291, dated Jan. 5, 2017, 15 pages.

(Continued)

*Primary Examiner* — Jennifer H Gay

(57) ABSTRACT

Drilling flow control tools may include a tool body having a central bore and bypass ports that allow flow of fluid to an outer surface of the tool body. The drilling flow control tool may also include a control sleeve within the central bore. The control sleeve may restrict fluid flow through the bypass ports when in an inactive state and allow the fluid flow through the bypass ports when in an active state. The drilling flow control tool may further include a release subassembly movably coupled to the tool body. Packer cups coupled to the tool body can act as packoff devices that control passage of fluid along the outer diameter of the tool body. Using the packer cups and control sleeve, fluid flow may be circulated within an inner annulus of a wellbore, an outer annulus of a wellbore, or both.

19 Claims, 6 Drawing Sheets

(51) Int. Cl.

| | |
|---|---|
| ***E21B 33/14*** | (2006.01) |
| ***E21B 34/00*** | (2006.01) |
| ***E21B 34/10*** | (2006.01) |
| ***E21B 34/14*** | (2006.01) |
| ***E21B 33/126*** | (2006.01) |

(52) U.S. Cl.
CPC ..... *E21B 33/126* (2013.01); *E21B 33/14* (2013.01); *E21B 34/103* (2013.01); *E21B 34/14* (2013.01); *E21B 2034/007* (2013.01)

(56) References Cited

U.S. PATENT DOCUMENTS 3,503,445 A * 3/1970 Cochrum ..... E21B 21/103 166/151
3,606,924 A * 9/1971 Malone ..... E21B 21/00 166/187
3,850,240 A * 11/1974 Conover ..... E21B 23/06 166/162
4,889,199 A * 12/1989 Lee ..... E21B 21/003 175/317
4,917,191 A 4/1990 Hopmann et al.
5,090,481 A 2/1992 Pleasants et al.
5,117,910 A * 6/1992 Brandell ..... E21B 33/126 166/154
5,318,118 A * 6/1994 Duell ..... E21B 33/126 166/202
5,411,095 A * 5/1995 Ehlinger ..... E21B 34/102 166/154
7,108,080 B2 9/2006 Tessari et al.
7,373,988 B2 5/2008 Campbell et al.
7,647,990 B2 1/2010 Tessari et al.
7,784,552 B2 8/2010 Brouse
7,926,578 B2 4/2011 Moffitt et al.
7,926,590 B2 4/2011 Eriksen et al.
8,387,693 B2 3/2013 Tunget
9,650,859 B2 * 5/2017 Zhou ..... E21B 17/1078
2003/0146001 A1 * 8/2003 Hosie ..... E21B 4/02 166/369
2004/0003944 A1 * 1/2004 Vincent ..... E21B 7/208 175/57
2004/0069504 A1 * 4/2004 Krueger ..... E21B 21/00 166/387
2005/0051342 A1 3/2005 Campbell et al.
2007/0261850 A1 * 11/2007 Giroux ..... E21B 7/20 166/291
2008/0128140 A1 * 6/2008 Giroux ..... E21B 4/02 166/381
2009/0090508 A1 4/2009 Brouse
2009/0288839 A1 11/2009 Eriksen et al.
2009/0288841 A1 11/2009 Eriksen et al.
2009/0288886 A1 11/2009 Eriksen et al.
2010/0155067 A1 * 6/2010 Tunget ..... E21B 23/14 166/285
2011/0056703 A1 * 3/2011 Eriksen ..... E21B 7/20 166/381
2011/0203794 A1 8/2011 Moffitt et al.
2012/0018172 A1 1/2012 Javed
2012/0090847 A1 * 4/2012 Getzlaf ..... E21B 23/02 166/305.1
2012/0175108 A1 * 7/2012 Foubister ..... E21B 33/1294 166/250.01
2012/0222861 A1 9/2012 Eriksen
2012/0261127 A1 * 10/2012 Zhou ..... E21B 21/103 166/289
2012/0279705 A1 11/2012 Moffitt
2014/0054036 A1 2/2014 Regener et al.
2014/0251616 A1 * 9/2014 O'Rourke ..... E21B 29/005 166/298
2015/0330180 A1 * 11/2015 Barannikow ..... E21B 33/12 166/285
2016/0024876 A1 * 1/2016 Ward ..... E21B 34/063 166/285
2016/0265295 A1 * 9/2016 Plante ..... E21B 29/002
2017/0130561 A1 * 5/2017 Eriksen ..... E21B 21/103
2018/0209223 A1 * 7/2018 Ojong ..... E21B 17/046

OTHER PUBLICATIONS

Written Opinion and International Search Report for International Application No. PCT/US2015/037291, dated Sep. 23, 2015, 23 pages.
http://www.slb.com/services/miswaco/services/completions/specialized_tools/circulating_tools/ported_bypass_sub.aspx.
hittp://www.slb.com/services/miswaco/services/completions/specialized_tools/circulating_tools/well_commander.aspx.

* cited by examiner

DRILLING FLOW CONTROL TOOL

CROSS-REFERENCE TO RELATED APPLICATIONS

The present application claims priority to U.S. Provisional Patent Application 62/017,175 filed Jun. 25, 2014, the entirety of which is incorporated by reference.

TECHNICAL FIELD

Some embodiments of the present disclosure relate to downhole tools. In a more particular aspect, additional embodiments of the present disclosure relate to flow control tools for casing-while-drilling or liner-while-drilling systems.

BACKGROUND

An oil and gas well may be drilled with drill pipe to a certain depth. Casing may thereafter be run and cemented in the well. An operator may then continue to drill the well to a greater depth with drill pipe and cement in still another string of casing. In this type of system, each string of casing may extend to a surface wellhead assembly.

In some well completions, an operator may install a liner rather than a string of casing. The liner may be made up of joints of pipe in the same manner as casing, and may also be cemented into the well. The liner, however, may not extend back to the surface wellhead assembly. Instead, the liner may be secured by a liner hanger to just above a lower end of the last string of casing. To cement the liner, the operator may set the liner hanger and pump cement through the liner, such that the cement may flow into an annulus between the liner and the well.

In some drilling scenarios, when installing a liner, the operator may drill the well to a certain depth using a drill string, retrieve the drill string, and then assemble and lower the liner into the well. In other scenarios, the operator may run the liner while drilling the well.

SUMMARY

In one non-limiting embodiment, a flow control tool may include a tool body with a central bore. A bypass valve may extend through the tool body and allow fluid flow to move radially out of the tool body from the central bore. A control sleeve within the central bore may be movable between active and inactive states. In the inactive state, the control sleeve may restrict fluid flow through the bypass port. In the active state, the control sleeve may allow fluid flow through the bypass port. A release subassembly coupled to the tool body may move between an open state and a closed state which changes the position of a packoff device that controls passage of fluid along an outer surface of the tool body.

In another non-limiting embodiment of the present disclosure, a casing-while-drilling system may include a liner, bottomhole assembly below the liner, and a drilling flow control tool coupled to the liner. The bottomhole assembly may include a drill bit and an underreamer. The drilling flow control tool may include a tool body with a central bore and a bypass port. The bypass port may allow fluid to flow radially from the central bore to an outer diameter of the tool body. A control sleeve within the central port may, when in an inactive state, restrict fluid flow through the bypass port. When the control sleeve is in an active state, fluid flow may be allowed through the bypass port. A release subassembly may be coupled to the tool body and may move between open and closed states. The release subassembly may include a packer cup controlling passage of fluid along the outer diameter of the tool body.

According to still another non-limiting embodiment, a method may include tripping a drill string into a wellbore. The drill string may include a flow control tool within a liner. The flow control tool may include a central bore, a bypass port, and a flow passage. The bypass port may allow fluid flow radially outwardly from the central bore to an outer diameter of the tool body. The flow passage may extend axially along the outer diameter of the tool body. A control sleeve of the flow control tool may be coupled to the tool body and may be in an inactive state restricting fluid flow through the bypass port. A release subassembly of the flow control tool may be movably coupled to the tool body and positioned in an open state in which a packoff device allows fluid flow through the flow passage. The control sleeve may transition from the inactive state to an active state, and may thereby allow fluid flow through the bypass port.

This summary is provided to introduce a selection of concepts in a simplified form that are further described below in the detailed description. The summary is not intended to identify key or essential components, nor is it intended to be used to limit the scope of the claimed subject matter.

BRIEF DESCRIPTION OF THE DRAWINGS

Examples of various embodiments will be described herein with reference to the accompanying drawings. It should be understood, however, that the accompanying drawings illustrate some of the various embodiments that are specifically described herein and are not meant to limit the scope of the claims or any particular embodiment of the present disclosure.

DETAILED DESCRIPTION

Reference will now be made in detail to various embodiments, examples of which are illustrated in the accompanying drawings and figures. In the following detailed description, numerous specific details are set forth in order to provide a thorough understanding of the present disclosure. It will be apparent to one of ordinary skill in the art, however, that the present disclosure may be practiced without these specific details. In other instances, well-known methods, procedures, components, tools, and the like have not been described in detail so as not to obscure aspects of the present disclosure.

One or more embodiments of various embodiments for using a drilling flow control tool will now be described in more detail with reference to FIGS. 1-10. In oil and gas operations, a wellbore may be drilled to a particular depth with a drill string, which may include a drilling bottomhole assembly ("BHA"). Once the particular depth is reached, the drill string may be removed from the wellbore and casing may be run into the vacant hole. In one embodiment, the casing may be installed as part of the drilling process. A process that involves running casing at the same time the wellbore is being drilled may be referred to as "casing-while-drilling." A process that involves running a liner at the same time the wellbore is being drilled may be referred to as "liner-while-drilling" or more generally may be included as a type of casing-while-drilling operation.

Figure 1:
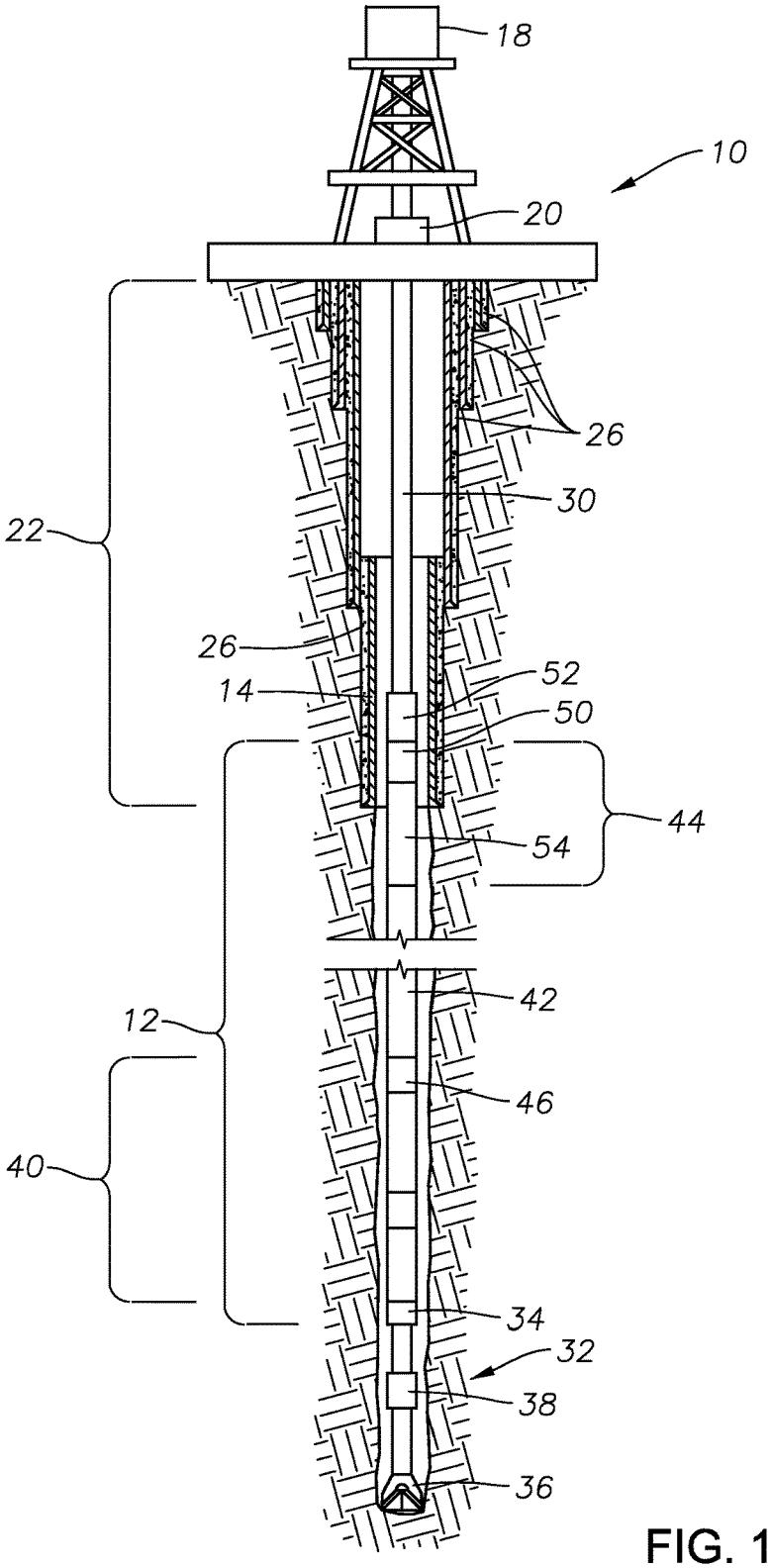
FIG. 1 is a schematic representation of a wellbore in accordance with some embodiments of the present disclosure.

FIG. 1 is a schematic representation of a wellbore 10 in accordance with one or more embodiments described herein. As illustrated, the wellbore 10 may be drilled using a casing-while-drilling process or system/. For instance, a liner 12 may be hung within a previously installed casing 14 that was cemented into the wellbore 10. The system illustrated in FIG. 1 may also include, at the site of the wellbore 10, a derrick 18, wellhead equipment 20, or one or more types of casing 22 (e.g., conductor pipe, surface pipe, intermediate string, production casing, production liner, etc.). In some embodiments, the casing 22 may include previously installed casing 14. In one embodiment, the previously installed casing 14 may include one or more liner portions. In other embodiments, the previously installed casing 14 may include casing that extends to the surface. The previously installed casing 14 may also include combinations of casing and liner. The casing 22 and the previously installed casing 14 may be cemented into the wellbore 10 with cement 26.

The previously installed casing 14 may be a pipe or tubular placed in the wellbore 10 to provide structural integrity and prevent the wellbore 10 from caving in. The previously installed casing 14 may also isolate one or more portions of the wellbore 10 so as to contain fluids therein or limit fluids from the surrounding formation from entering the wellbore 10. In still other embodiments, the previously installed casing 14 may assist with efficient extraction of product (e.g., oil, gas, water, etc.). Upon properly positioning the previously installed casing 14 within the wellbore 10, the previously installed casing 14 may be cemented in place by pumping cement 26 through the previously installed casing 14 and into an outer annulus extending radially between an outer surface or outer diameter of the previously installed casing 14 and an inner diameter or inner surface of the wellbore 10 (e.g., formed in the formation and/or in a parent or host casing).

To install the previously installed casing 14, the cement 26 may fill at least a portion of the previously installed casing 14 such that an initial amount of cement 26 may be forced, by the accumulated head of cement and/or pumping pressure, out of the bottom of the previously installed casing 14 and up along the outer diameter of the previously installed casing 14, such that the cement 26 passes into the outer annulus. The cement 26 may then cure and harden to cement the previously installed casing 14 in place. In some embodiments, a sufficient amount of cement 26 may therefore be pumped through the previously installed casing 14 and forced out of the interior of the previously installed casing 14 and into the outer annulus by pushing a plug through the previously installed casing 14 with pressurized displacement fluid.

Once the previously installed casing 14 has been positioned and cemented in place or installed, additional casing strings may be installed via the previously installed casing 14. For example, the wellbore 10 may be drilled further by passing a drilling BHA through the previously installed casing 14. Further, additional casing strings may then be subsequently passed through the previously installed casing 14 (during or after drilling) for installation. Thus, as mentioned herein, one or more levels of casing 22 may be employed in a wellbore 10.

The liner 12 may be a string of pipe or another type of tubular that may be used to case an open hole below the previously installed casing 14. In one embodiment, the liner 12 may extend a certain distance into previously installed casing 14, and the previously installed casing 14 may extend back to a wellhead assembly at the surface or may extend a certain distance into an immediately adjacent portion of the casing 22. Thus, a tieback string of the previously installed casing 14 may be installed that extends from the wellhead downward into engagement with previously installed casing 14 shown in FIG. 1.

Where the liner 12 extends a certain distance into the previously installed casing 14, that distance may be varied as desired. Increased overlap may provide for additional strength or structural integrity, while reduced overlap may provide for reduced materials and cost due to increased depth of the distal end of the liner 12 within the wellbore 10. In some embodiments, the amount of overlap between the liner 12 and the previously installed casing 14 may be between 0.5 m and 60 m. More particularly, the amount of overlap may be within a range including lower and upper limits that include any of 0.5 m, 1 m, 2 m, 5 m, 10 m, 15 m, 20 m, 25 m, 30 m, 35 m, 40 m, 50 m, 60 m, and any values therebetween. For instance, the overlap of the liner 12 and the previously installed casing 14 may be between 0.5 m and 20 m, between 20 m and 40 m, or between 40 m and 60 m. In one particular embodiment, for instance, the overlap may be 30 m. In still other embodiments, the amount of overlap may be less than 0.5 m or greater than 60 m.

The liner 12 may be coupled to the previously installed casing 14 by a liner hanger 50. The liner hanger 50 may be coupled to the liner 12 and may be engaged with the interior of the previously installed casing 14. The liner hanger 50 may include a slip device (e.g., a device with teeth, serrated edges, other gripping features, or any combination of the foregoing) that engages the interior of the previously installed casing 14 to hold the liner 12 in place. In some embodiments, the liner 12 may extend from a previously installed liner or parent or host liner. In another embodiment, the liner 12 may be cemented into the wellbore 10 in a similar manner as the previously installed casing 14 as described herein.

With continued reference to FIG. 1, in a casing-while-drilling and/or liner-while-drilling system or process, the liner 12 may be run as part of the drilling process. Further, an inner string 30 may be positioned within the liner 12. The inner string 30 may include a drilling BHA 32. In one embodiment, at least a portion of the drilling BHA 32 may be within the liner 12. For instance, an upper portion of the drilling BHA 32 may be within an inside diameter of the liner 12, while a lower portion of the drilling BHA 32 may extend out of a liner shoe 34 at the bottom or downhole portion of the liner 12. For example, a drill bit 36 and an underreamer 38 of the drilling BHA 32 may extend out from the liner 12. The underreamer 38 may enlarge the wellbore initially drilled by the drill bit 36, and may be retractable for disposition inside the liner 12. In other embodiments, the underreamer 38 may be a fixed diameter and operate as a hole opener. In such an embodiment, the underreamer 38 may be sacrificial and may be left within the wellbore 10. Other components of the drilling BHA 32 that may also extend from the liner 12 may include directional control and steering equipment, logging instruments, sensors, telemetry or communication equipment, stabilizers, or the like. Thus, in some embodiments, the drilling BHA 32 may be positioned to initiate and guide the drilling process.

The liner 12 may, in some embodiments, include a shoe track 40, a string of casing 42, and a liner top assembly 44. The shoe track 40 may define a bottom portion of the liner 12 and may include the liner shoe 34 to facilitate guiding the liner 12 through the wellbore 10. Further, the shoe track 40 may include an indicator landing sub 46 to facilitate proper engagement with the drilling BHA 32. Various additional or other features may also be included, including a pump down displacement plug ("PDDP") landing profile. The string of casing 42 may be include a main body of the liner 12 which connects the shoe track 40 with the liner top assembly 44. The string of casing 42 may include a single pipe or tubular, or may include multiple segments of pipes or tubulars that are connected together in an end-to-end fashion. For instance, external threads may be formed on the segments of the tubulars making up the string of casing 42, and couplings may couple two adjacent tubulars together. In other embodiments, tool joints (e.g., a threaded pin on one tubular mating with a threaded box on another tubular), clamps, or other connectors may be used to couple together multiple segments of tubulars.

The liner top assembly 44, which may define a top portion of the liner 12, may include the liner hanger 50. The liner hanger 50 may be activated and/or deactivated by a liner hanger control tool 52. The liner top assembly 44 may also include a liner drill lock section 54, which may include a liner drill lock to facilitate engagement and/or disengagement of the inner string 30 from the liner 12. The liner drill lock may be actuated by external or internal components affixed to or part of a body of the liner hanger 50.

Once a particular depth is reached, the liner 12 may be hung or set down to facilitate detachment of the drilling BHA 32. The liner 12 may be hung from the previously installed casing 14, and the drilling BHA 32 may be detached from the liner 12. The drilling BHA 32 may be pulled through the liner 12 and potentially out of the wellbore 10 using the inner string 30. In order to hang the liner 12 from the previously installed casing 14, the liner hanger 50 may be activated with the liner hanger control tool 52. In some embodiments, the liner hanger 50 may not be utilized and the liner 12 may be set on bottom.

Upon activating the liner hanger 50, the weight of the liner 12 may be placed on the liner hanger 50. The inner string 30 may be released from the liner 12, allowing the inner string 30 to be pulled from the wellbore 10. The drilling BHA 32 may be pulled through the liner 12 with the inner string 30, such that it is pulled out of the liner top assembly 44 and potentially out of the wellbore 10. Thus, the liner 12 may be hung in the parent or host casing (e.g., previously installed casing 14), the drilling BHA 32 may be removed, and the liner 12 may then be ready for cementing.

Figure 2:
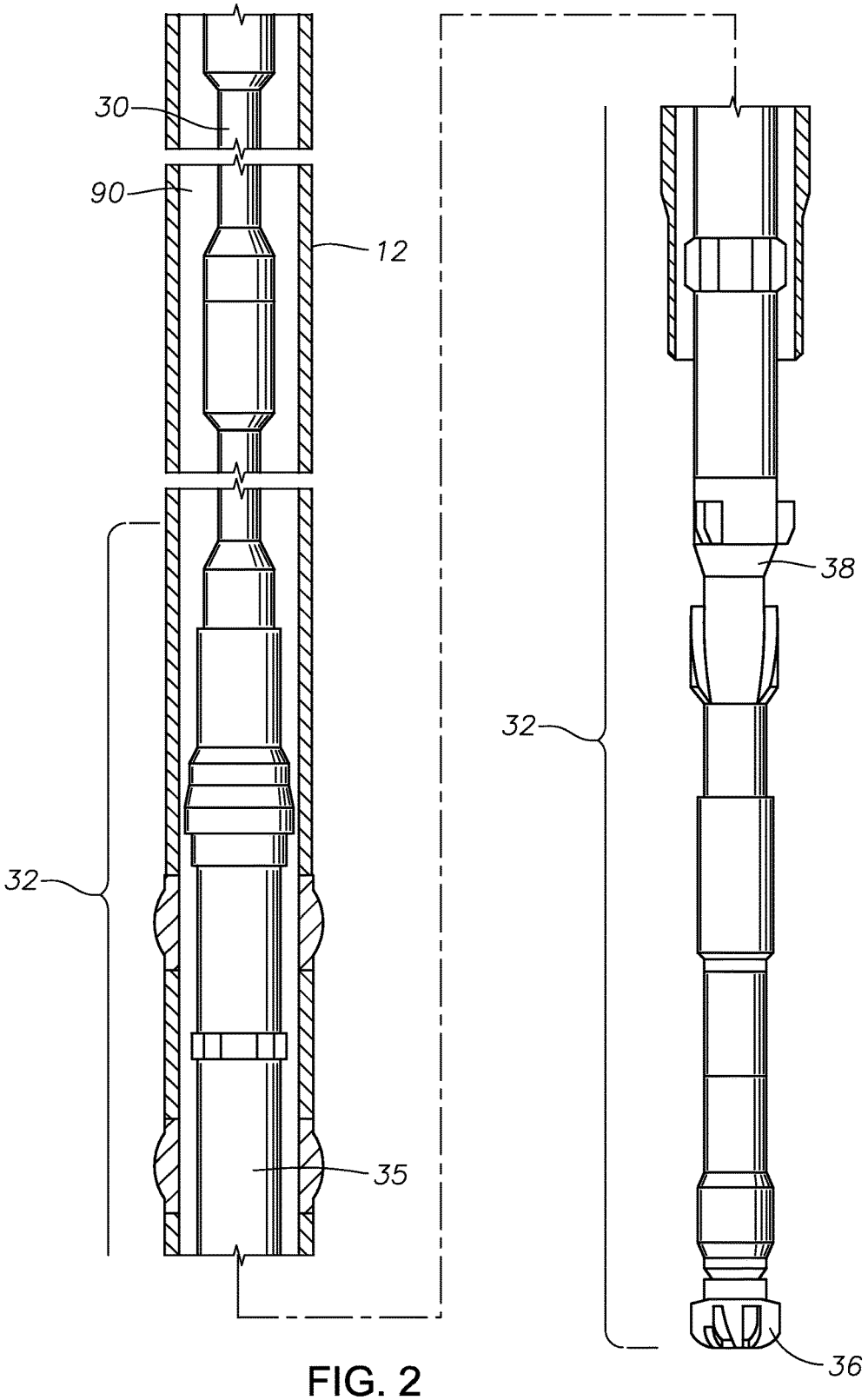
FIG. 2 is a partial cross-sectional side view of a liner and an inner string in accordance with some embodiments of the present disclosure.
Figure 3:
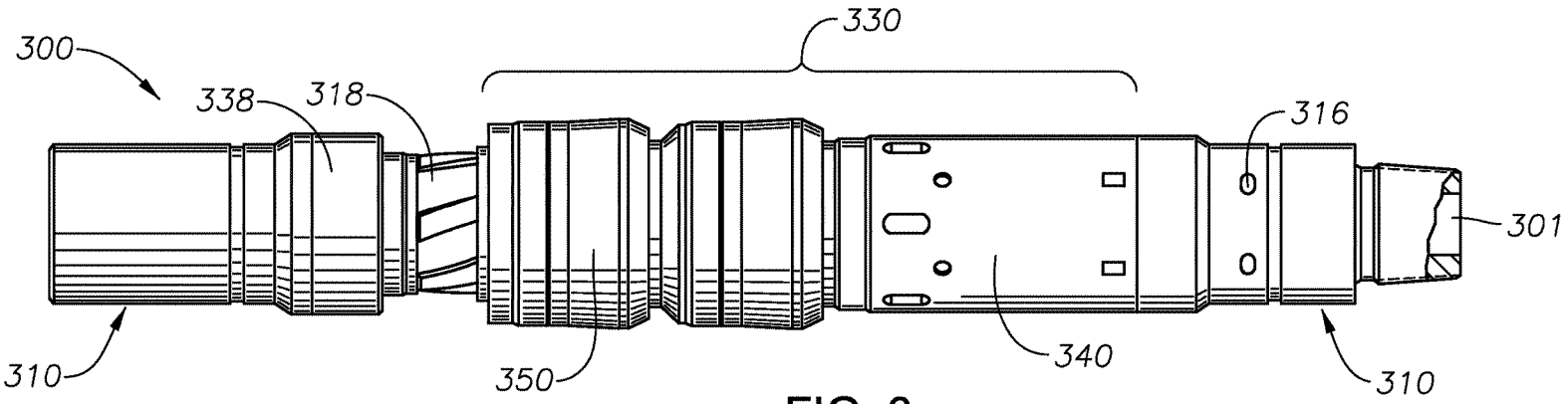
FIG. 3 is a side view of a drilling flow control tool in accordance with some embodiments of the present disclosure.
Figure 4:
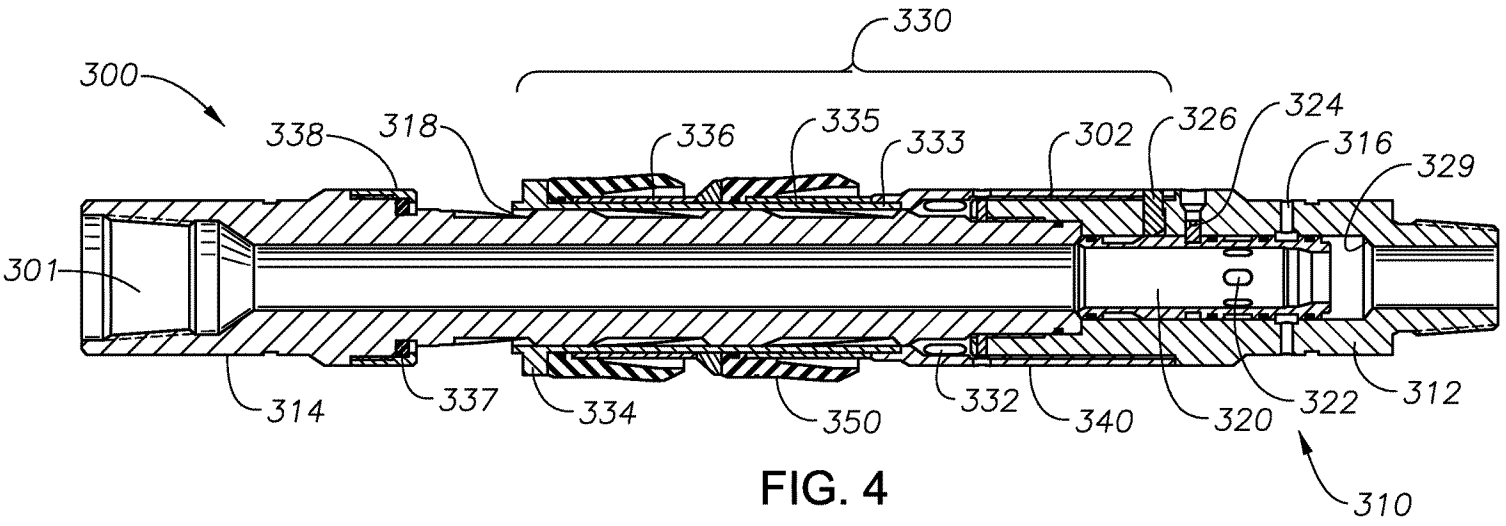
FIG. 4 is a cross-sectional side view of the drilling flow control tool of FIG. 3 in accordance with some embodiments of the present disclosure.

FIG. 2 is a partial cross-sectional side view of the liner 12 and the inner string 30, and provides a view of the interior of the liner 12 in accordance with some embodiments of the present disclosure. As shown, the inner string 30 may include or be coupled to the drill bit 36 and the underreamer 38 of the drilling BHA 32, which may extend axially downhole from, and potentially out of, the liner 12. The inner string 30 may also include a motor 35. In some embodiments, the motor 35 may be mud motor (e.g., a positive displacement motor, progressive cavity pump, Moineau pump, etc.), a turbine or turbodrill motor, or some other downhole device for use in rotating the drill bit 36. In at least some embodiments, the motor 35 may rotate the drill bit 36 relative to the inner string 30 in response to drilling fluid being pumped down a bore of the inner string 30. In another embodiment, the inner string 30 may be rotated via a top drive, power tongs, rotary table, or other device at the surface of a wellbore, which may cause the drill bit 36 to rotate. The liner 12 may rotate in unison with the inner string 30 and/or the drill bit 36.

In another embodiment, during drilling, drilling fluid may flow through nozzles of the drill bit 36 and up the outer annulus surrounding the liner 12. The drilling fluid may be used to cool cutting elements of the drill bit 36, lubricate the drill bit 36, remove cuttings drilled by the drill bit 36 from the face of the drill bit 36, to provide solids transport to carry cuttings to the surface, for other purposes, or for any combination of the foregoing. Cuttings may therefore combine with the drilling fluid from the nozzles of the drill bit 36 and flow up through the outer annulus.

In one embodiment, a drilling flow control tool may be used with the inner string 30 to direct or define a flow path for fluid, cuttings, other components, or any combination of the foregoing within the wellbore 10. For instance, and as further described herein, a drilling flow control tool may control the fluid flow through a bore of the inner string 30, through an inner annulus 90 formed between an inner diameter of the liner 12 and an outer diameter of the inner string 30, through the outer annulus formed between the outer diameter of the liner 12 and the inner diameter of the wellbore or host casing, or any combination of the foregoing. In another embodiment, the drilling flow control tool may be part of the inner string 30, and may be fully or partially inside the liner 12. In some embodiments, the drilling flow control too may be located above or uphole of the drilling BHA 32.

FIGS. 3 through 6 illustrate some example embodiments of a flow control tool 300, or components thereof, in accordance with embodiments of the present disclosure. In one embodiment, the flow control tool 300 may include a tool body 310, a control sleeve 320, and a release subassembly 330.

According to at least one embodiment, the tool body 310 may be part of an inner string (e.g., inner string 30 of FIG. 2) and may include a lower sub 312 and/or an upper sub 314.

The lower sub 312 may be coupled to the upper sub 314 through the use of threads, screws, bolts, welds, clamps, clasps, other connection mechanisms, or through any combination of the foregoing. The tool body 310 may be oriented such that the upper sub 314 may engage with uphole members of an inner string and the lower sub 312 may engage with downhole members of the inner string or components coupled thereto (e.g., drilling BHA 32 of FIG. 2). In some embodiments, the tool body 310 may be fully or partially within a liner. A central bore 301 may extend through the tool body 310, including through various components of the tool body 310 or coupled to the tool body 310.

Figure 5:
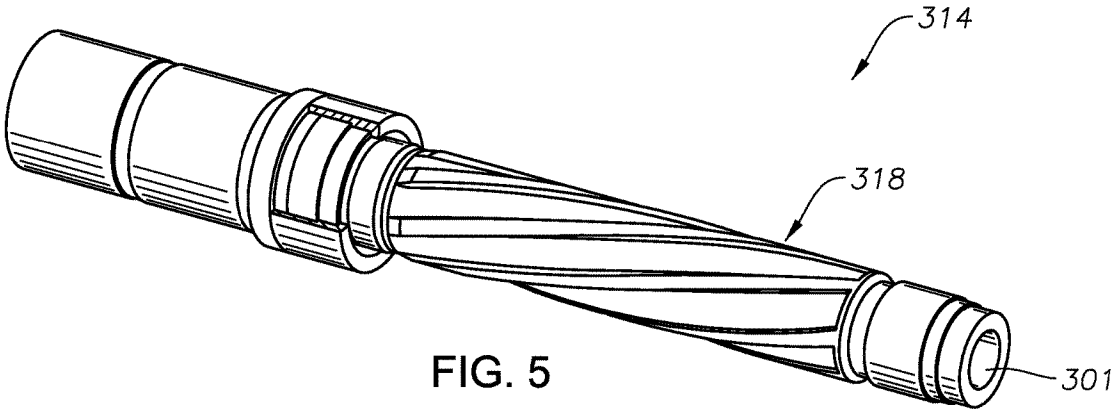
FIG. 5 is a perspective view of an upper sub in accordance with some embodiments of the present disclosure.

In one embodiment, the lower sub 312 may include one or more bypass ports 316, which may allow fluid to flow and pass from the central bore 301 to an inner annulus (e.g., inner annulus 90 or FIG. 2). In another embodiment, the upper sub 314 may include flow passages 318 that extend longitudinally along an outer diameter of the upper sub 314. FIG. 5 shows an example of the flow passages 318 in additional detail. As shown, the flow passages 318 may optionally extend both axially and circumferentially around a portion of the outer diameter of the upper sub 314.

Any number of flow passages 318 may be included. For instance, in some embodiments, there may be between 1 and 20 flow passages 318. More particularly, the number of flow passages 318 may be within a range having lower and upper limits that include any of 1, 2, 3, 4, 5, 6, 7, 8, 10, 12, 15, 18, 20, or any value therebetween. For instance, there may be between 1 and 10 flow passages 318, between 4 and 8 flow passages 318, or between 3 and 6 flow passages 318. In still other embodiments, there may be no flow passages 318 or more than 20 flow passages 318. Additionally, the flow passages 318 may have any suitable construction. For instance, the flow passages 318 may be formed as grooves or slots on the outer diameter of the tool body 310 or the upper sub 314. In other embodiments, however, protrusions, ridges, baffles, or other structures may define the flow passages 318. Combinations of different structures may also form the flow passages 318.

Figure 6:
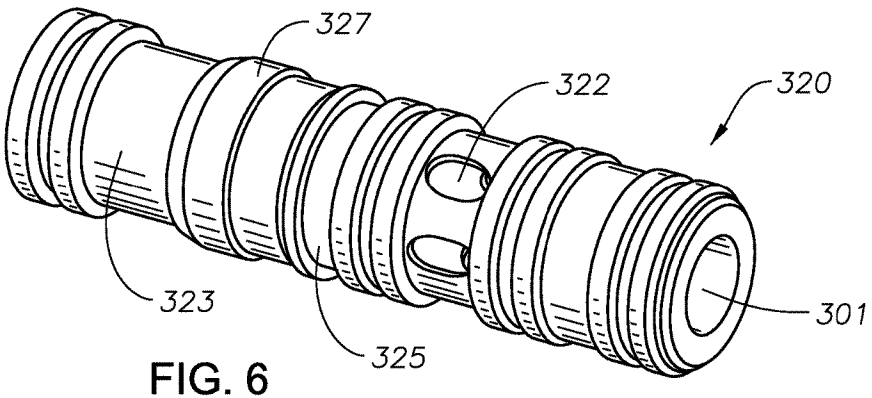
FIG. 6 is a perspective view of a control sleeve in accordance with some embodiments of the present disclosure.

The control sleeve 320 may be positioned fully or partially within a bore of the lower sub 312. As shown in FIG. 6, the control sleeve 320 may be substantially cylindrical and may include flow ports 322. There may be one or more of the flow ports 322, and the flow ports 322 may extend radially through the control sleeve 320 and allow a fluid to pass from a bore of the control sleeve 320 to an outer diameter of the control sleeve 320. A portion of the central bore 301 in the tool body 310 may extend through the control sleeve 320. As such, and as described in greater detail herein, the flow ports 322 may be used to allow the fluid flow to pass from the central bore 301 to an inner annulus.

In one embodiment, and as further described herein, the control sleeve 320 may move axially within the bore of the lower sub 312 between a first or "inactive" state and a second or "active" state. In the inactive state, the one or more flow ports 322 may not align with the one or more bypass ports 316. Accordingly, in the "inactive" state, fluid flow may be restricted to reduce or even prevent fluid flow from the central bore 301 to an inner annulus. In the active state, the flow ports 322 may align with the one or more bypass ports 316, thereby allowing fluid flow to pass from the central bore 301 to the inner annulus.

When the control sleeve 320 is in its inactive state, an uphole end of the control sleeve 320 may be seated against a downhole end of the upper sub 314. In one embodiment, one or more shear elements 324 (e.g., shear screws, shear pins, burst devices, etc.) extending from an inner diameter of the lower sub 312 may engage with one or more grooves 325 along an outer diameter of the control sleeve 320, as shown in FIG. 6. With the shear elements 324 engaged with the one or more grooves 325, the control sleeve 320 may be locked into the inactive state. In another embodiment, with the control sleeve 320 in such a state, a shoulder 327 on the outer diameter of the control sleeve 320 may cause one or more locking pins 326 in a housing of the lower sub 312 to move radially outward. The one or more locking pins 326 may protrude out of the outer diameter of the lower sub 312. As further described herein, when the one or more locking pins 326 protrude from this outer diameter, they may restrict and potentially prevent a rotation of the release subassembly 330 relative to the tool body 310. In such an embodiment, the shoulder 327 may be a locking shoulder.

When the control sleeve 320 is in an active state, a downhole end of the control sleeve 320 may be seated against an internal shoulder 329 of the lower sub 312. The internal shoulder 329 may be formed by a change in diameter of the bore of the lower sub 312, or by inserting a smaller diameter sleeve inside the bore of the lower sub 312. In such a state, the one or more shear elements 324 may have failed, thereby no longer keeping the control sleeve 320 locked. In one embodiment, in such a state, the one or more locking pins 326 may no longer be pushed by the shoulder 327, and may instead move radially inward to rest against a locking recess 323 (see FIG. 6). In such an embodiment, the one or more locking pins 326 may no longer protrude from the outer diameter of the lower sub 312.

The release subassembly 330 may be movably coupled to the outer diameter of the lower sub 312, and may at least partially cover the flow passages 318 of the upper sub 314. In one embodiment, the release subassembly may include an outer sleeve 340 and one or more pack-offs, which are illustrated in this embodiment as packer cups 350. The outer sleeve 340 may be downhole relative to the packer cups 350.

The outer sleeve 340 may be movably coupled to the outer diameter of the lower sub 312. In particular, an inner diameter of the outer sleeve 340 may be coupled to the outer diameter of the lower sub 312 via threads 302 or some other connection mechanism. In such an embodiment, a downhole portion of the outer sleeve 340 may be coupled to an uphole portion of the lower sub 312.

According to at least some embodiments, the outer sleeve 340 may move axially relative to the tool body 310. For instance, the threads 302 may allow the outer sleeve 340 to move axially relative to the tool body 310. As further described herein, slacking off and turning an inner string at the surface may cause the outer sleeve 340 to move axially relative to the inner string. In a further embodiment, the outer sleeve 340 may be restricted and potentially prevented from moving axially using the threads 302 (e.g., if the one or more locking pins 326 protrude out of the outer diameter of the lower sub 312). In such an embodiment, the one or more locking pins 326 may engage with an inner diameter of the outer sleeve 340 to restrict or prevent axial movement.

The outer sleeve 340 may also include ports 332. There may be one or more of the ports 332, and the ports 332 may be configured to allow fluid flow to pass between a downhole side of the flow passages 318 and an inner annulus (e.g., inner annulus 90 of FIG. 2). The outer sleeve 340 may also be coupled to a seal sleeve 333. The seal sleeve 333 may be positioned along the outer diameter of the upper sub 314, and potentially over at least part of the flow passages 318. In one embodiment, a downhole end of the seal sleeve 333 may be coupled to an uphole end of the outer sleeve 340.

More particularly, the seal sleeve 333 may be inserted into a bore of the outer sleeve 340, and may be coupled to the outer sleeve 340 using a locking wire, locking pin, other connection mechanism, or any combination of the foregoing.

The packer cups 350 may be on an outer diameter of the seal sleeve 333. In some embodiments, a clearance between an outer diameter of the packer cups 350 and the inner diameter of a liner (e.g., liner 12 of FIG. 2) may be minimized. In such an embodiment, the packer cups 350 may be configured to impose a drag on this inner diameter. According to such an embodiment, fluid flow may potentially not have sufficient clearance to pass between the outer diameter and the inner diameter. Thus, the outer diameter of the packer cups 350 may block fluid flow from passing through an inner annulus from either above or below the packer cups 350.

An uppermost or furthest uphole one of the packer cups 350 may engage with a head portion 334 of the seal sleeve 333. In particular, the uppermost one of the packer cups 350 may be frictionally engaged with a downhole side of the head portion 334. The head portion 334 may have a larger outer diameter than the rest of the seal sleeve 333. Similarly, a lowermost or furthest downhole one of the packer cups 350 may engage with the outer sleeve 340. In particular, the lowermost one of the packer cups 350 may be frictionally engaged with an uphole end of the outer sleeve 340. In one embodiment, a biasing member such as cup spring 335 may be located axially between an inner portion of the packer cups 350 and the uphole end of the outer sleeve 340. The cup spring 335 may be on the outer diameter of the seal sleeve 333. In another embodiment, the packer cups 350 may be frictionally engaged with one another. For instance, a cup spacer 336 may be between an inner portion of one of the packer cups 350 and an uphole end of another one of the packer cups 350. Further, the cup spacer 336 may be on the outer diameter of the seal sleeve 333.

In one embodiment, when an uphole end of the seal sleeve 333 fails to form a sufficient seal with a downhole end of an unloader seal 337, the release subassembly 330 may be considered to be in a first or "open" state. The unloader seal 337 may include a seal on an outer diameter of the upper sub 314 and above the flow passages 318. In some embodiments, the unloader seal 337 may be coupled to the upper sub 314 via a seal retainer 338.

In the open state, fluid flow in an inner annulus (e.g., inner annulus 90 of FIG. 2) above the release subassembly 330 may pass through an uphole end of the flow passages 318, through the flow passages 318, underneath the seal sleeve 333, through the ports 332, and into the inner annulus below the release subassembly 330. Similarly, in another embodiment, fluid flow in the inner annulus below the release subassembly 330 may pass in an opposite direction through the ports 332, through the flow passages 318, underneath the seal sleeve 333, through the uphole end of the flow passages 318, and into the inner annulus above the release subassembly 330.

In another embodiment, when the uphole end of the seal sleeve 333 forms a seal with the downhole end of the unloader seal 337, then the release subassembly 330 may be considered to be in a second or "closed" state. In such a state, the uphole end of the flow passages 318 may be covered by the packer cups 350. Thus, fluid flow in the inner annulus below the release subassembly 330 may be restricted or even prevented from passing through the uphole end of the flow passages 318 and into the inner annulus above the release subassembly 330, and vice versa. In another embodiment, fluid flow in the inner annulus above the release subassembly 330 may be allowed to pass into the inner annulus below the release subassembly 330 based on a differential pressure acting on the release subassembly 330. In particular, if there is a differential pressure acting on an uphole side of the release subassembly 330, the release subassembly 330 may shift to a more downhole position, or to an open state, and permit fluid flow in the inner annulus to pass from above to below the release subassembly 330.

The release subassembly 330 may transition between open and closed states by axially moving along the outer diameter of the tool body 310. For example, the release subassembly 330 may move from its open state to its closed state via the threads 302. In particular, as noted herein, slacking off and turning an inner string (e.g., inner string 30 of FIG. 2) at the surface may cause the outer sleeve 340 to move axially relative to the inner string. Assuming the locking pins 326 are not engaging the outer sleeve 340, the inner string may turn via the threads 332, while the drag imposed by the packer cups 350 may restrict or even prevent a similar turning of the release subassembly 330, including the outer sleeve 340. Thus, the inner string may be turned and rotated sufficiently to cause the release subassembly 330, and the uphole end of the seal sleeve 333 in particular, to move uphole along the tool body 310 until it forms a seal with the unloader seal 337, thereby moving the release subassembly 330 to a closed state.

Figure 7:
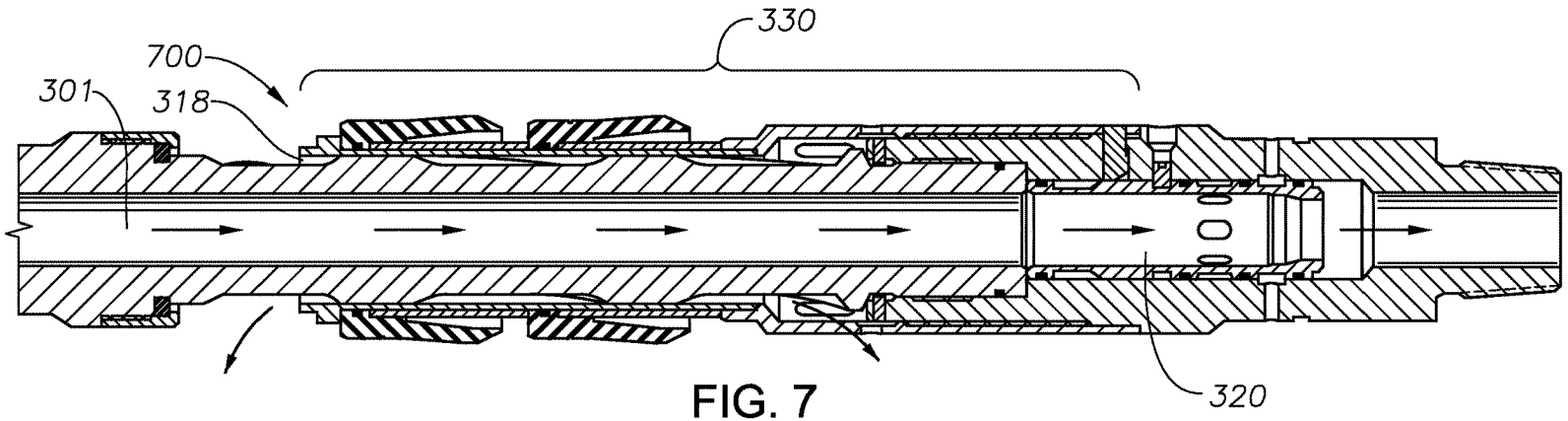
FIG. 7 is a cross-sectional side view of a drilling flow control tool during a running in and/or drilling operation in accordance with some embodiments of the present disclosure.

A flow control tool according to embodiments of the present disclosure may be used to control fluid flow during various phases of a downhole or other process. FIG. 7, for instance, illustrates a flow control tool 700 for use during a running in and/or drilling phase in accordance with embodiments of the present disclosure. As noted herein, a liner (e.g., liner 12 of FIG. 2) may be run into a wellbore simultaneously while the wellbore is being drilled. In such an embodiment, the control sleeve 320 may be in an inactive state and the release subassembly 330 may be in an open state, thereby allowing fluid flow to pass through both the central bore 301 and through an inner annulus (e.g., inner annulus 90 of FIG. 2) via the flow passages 318. In one embodiment, the fluid flow through the central bore 301 may be used to operate a motor of a BHA (e.g., motor 25 of drilling BHA 32 of FIG. 2).

Figure 8:
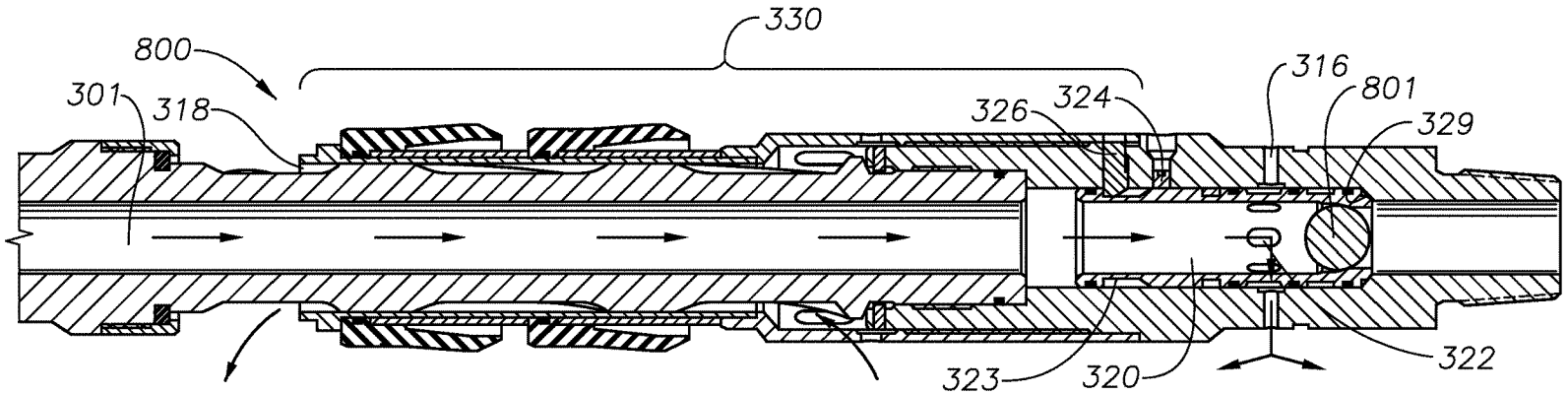
FIG. 8 is a cross-sectional side view of a drilling flow control tool while circulating fluid in an inner annulus in accordance with some embodiments of the present disclosure.

FIG. 8 illustrates a flow control tool 800 used to circulate fluid within an inner annulus, in accordance with embodiments of the present disclosure. As shown, an activation mechanism 801 may be used in connection with the control sleeve 320. In some embodiments, the activation mechanism 801 may include a ball, a dart, another type of obstruction device, an active or passive RFID tag, another type of activation mechanism, or any combination of the foregoing. In some embodiments, the activation mechanism 801 may be dropped down the central bore 301 until it reaches the control sleeve 320. Where the activation mechanism 801 includes a ball, dart, or other obstruction device, the activation mechanism 801 may create a blockage that limits or even prevents fluid flow from passing the activation mechanism 801 and continuing through the bore of the control sleeve 320.

In such an embodiment, a differential pressure across the control sleeve 320 may build, thereby producing a force which pushes on the control sleeve 320 in a downhole direction and in an increasing magnitude. In some embodiments, the differential pressure may cause the control sleeve 320 to move downhole. For instance, the force behind the activation mechanism 801 may reach an amount exceeding a threshold level for which the shear elements 324 are rated, thereby causing the shear elements 324 to fail. When the shear elements 324 shear or otherwise fail, the control sleeve 320 may be allowed to move axially within the flow control tool 800. Flow ports 322 of the control sleeve 320 may align with the one or more bypass ports 316, thereby allowing fluid flow to pass from the central bore 301, through the flow ports 322, through the one or more bypass ports 316, and into an inner annulus. Further, the one or more locking pins 326 may no longer be pushed by the shoulder 327 (see FIG. 6), and may instead move radially inward to rest against a locking recess 323. In such an embodiment, the one or more locking pins 326 may no longer engage with the inner diameter of the outer sleeve 340, and the release subassembly 330 may rotate relative to the tool body 310 (see FIG. 3).

Further, the release subassembly 330 may remain in an open state as previously shown in FIG. 7. Thus, the fluid flow passing into the inner annulus from the central bore 301 may be allowed to circulate in either the uphole or downhole directions. In another embodiment, a greater amount of the fluid flow may circulate in the inner annulus, as opposed to the outer annulus. Circulation in the inner annulus may be used to match a mud weight in the inner annulus with that of the central bore 301, which may be used to reduce or even prevent kick-outs, formation fluid from entering the wellbore, and the like.

Additionally, as further discussed herein, the central bore 301 may be closed off below a flow control tool 300, which may restrict or even prevent flow to a motor (e.g., motor 35 of FIG. 2), an underreamer (e.g., underreamer 38 of FIG. 2), or other components of a BHA (e.g., drilling BHA 32 of FIG. 2). Where the BHA is a drilling BHA, the flow control tool 300 may be a drilling flow control tool. In some embodiments, blocking such flow may minimize the risk of cutting a casing or liner (e.g., liner 12 of FIG. 2) with the underreamer when retrieving the BHA through the inside the casing or liner prior to circulating the outer annulus of the wellbore. Further, the BHA may be protected from solids, loss control material, and cement while in such a position.

Figure 9:
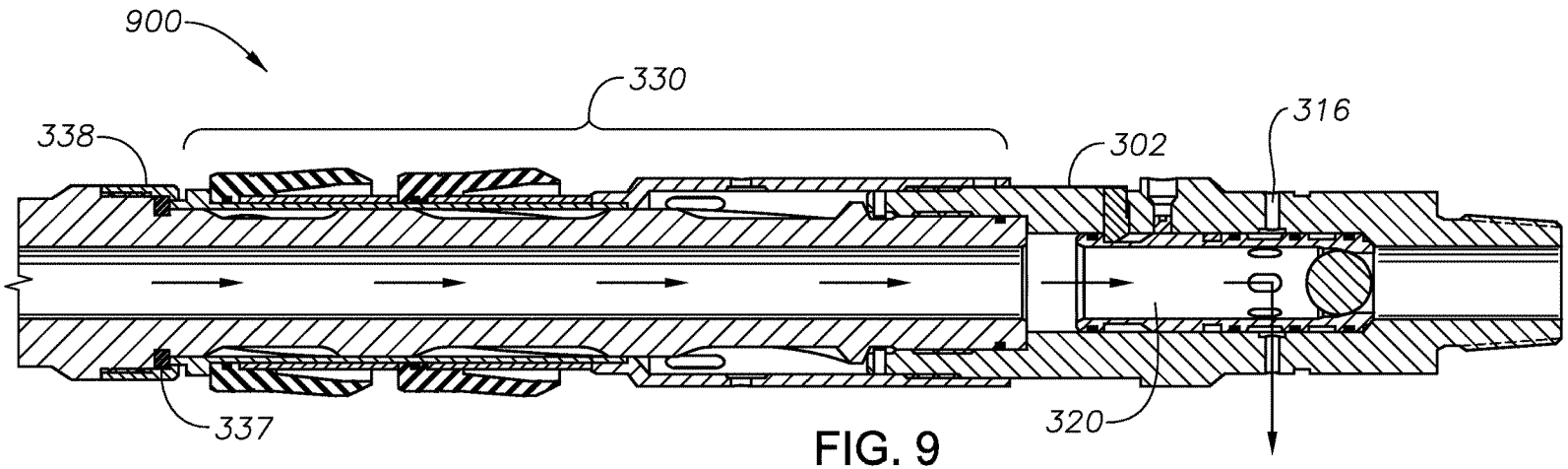
FIG. 9 is a cross-sectional side view of a drilling flow control tool while circulating fluid in an outer annulus in accordance with some embodiments of the present disclosure.

FIG. 9 illustrates a flow control tool 900 as it may be used to circulate fluid to an outer annulus in accordance with embodiments of the present disclosure. As shown, the control sleeve 320 may remain in an active state in which the central bore 301 is at least partially blocked to limit or prevent fluid from passing downhole. In such an embodiment, the fluid from the central bore 301 may be diverted via the one or more bypass ports 316 into an inner annulus.

A release subassembly 330 may, however, transition to a closed state. In the closed state, the release subassembly 330 may restrict or even prevent fluid flow from circulating uphole in the inner annulus. In one embodiment, slacking off and turning an inner string at the surface may cause the release subassembly 330 to form a seal with the unloader seal 337, i.e., to transition the release subassembly 330 to a closed state. Accordingly, the fluid flow from the central bore 301 may circulate in the downhole direction, such that the outer annulus is ultimately circulated with the fluid. In some embodiments, rotating the inner string may include rotating the inner string a particular number of times, or in a particular direction. For instance, the inner string may be rotated in a clockwise/rightward or counterclockwise/leftward direction. If the release subassembly is configured such that a particular number of rotations may transition the release subassembly 330 to the closed state, the number of rotations may be any value between 1 and 10 in some embodiments. For instance, 2, 3, 4, 5, or more rotations may be used to transition the release subassembly 330 to the closed state. In other embodiments, more than 10 rotations may be used, or less than 1 rotation (e.g., a partial rotation) may be used.

In another embodiment, the flow control tool 900 may be used to cement a liner in a wellbore. For instance, cement may be circulated instead of the fluid flow, such that the cement may ultimately be circulated into the outer annulus.

Figure 10:
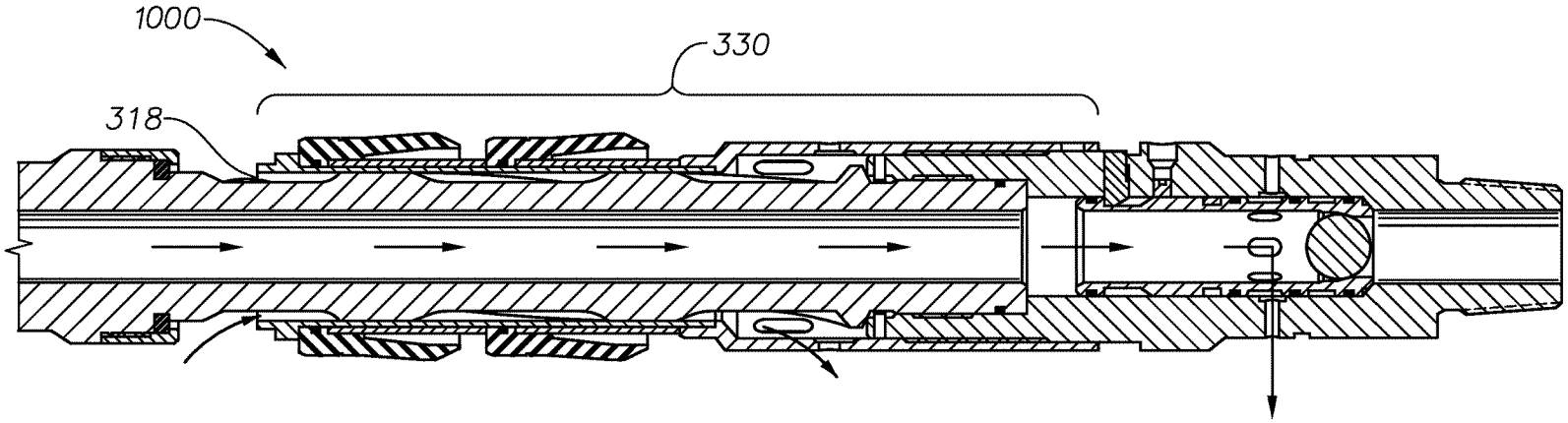
FIG. 10 is a cross-sectional side view of a drilling flow control tool while retrieving an inner string in accordance with some embodiments of the present disclosure.

FIG. 10 illustrates a flow control tool 1000 that may be used to retrieve an inner string (e.g., inner string 30 of FIG. 2) in accordance with embodiments of the present disclosure. As shown, the control sleeve 320 may be in an active state in which fluid flow is restricted or prevented through at least a portion of the central bore 301. Thus, the fluid from the central bore 301 may be diverted via the one or more bypass ports 316 into an inner annulus (e.g., an inner annulus between a liner and the flow control tool 1000).

The release subassembly 330 may, however, transition back to an open state, thereby allowing the fluid flow to circulate and move from the inner annulus above the release subassembly 330 to below the release subassembly 330. In one embodiment, as discussed herein, the release subassembly 330 may transition to the open state based on the differential pressure acting on the uphole side of the release subassembly 330. In another embodiment, the release subassembly 330 may transition to the open state by lifting or moving the tool body 310 (see FIG. 3) in the uphole direction. Due to the drag of a packoff device, the release subassembly 330 may remain in substantially the same position while the tool body 310 is lifted, thereby breaking the seal between the release subassembly 330 and the unloader seal 337. With the seal broken, the release subassembly 330 may be placed in the open state.

In such an embodiment, fluid that was above the release subassembly 330 in an inner annulus may flow in a downhole direction. Further, the flow control tool 1000 may facilitate retrieval of an inner string from the wellbore. In particular, by allowing the fluid in the inner annulus to drain below the inner string, underpressure and/or swabbing may be minimized or even avoided. Further, with the central bore 301 blocked, fluid flow to a motor and/or underreamer 38 may be blocked or restricted, thereby deactivating the motor or the underreamer, and maintaining the motor or underreamer in a deactivated state while inside a liner, casing, or other tubular during a retrieval process.

The discussion herein is directed to certain specific embodiments. It is to be understood that the discussion is for the purpose of enabling a person with ordinary skill in the art to make and use any subject matter defined now or later by the patent claims of any patent issuing from this disclosure. It is specifically intended that the claims not be limited to the embodiments and illustrations contained herein, but that the claims include modified forms of those embodiments, including portions of the embodiments and combinations of elements of different embodiments as come within the scope of the listed claims.

In the description herein, various relational terms are provided to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," "uphole," "downhole," and the like, may be used to describe various components, including their operation and/or illustrated position relative to one or more other components. Relational terms do not indicate a particular orientation or spatial relationship for each embodiment within the scope of the description or claims. For example, a component of a bottomhole assembly that is described as "below" another component may be further from the surface while within a vertical wellbore, but may have a different orientation during assembly, when removed from the wellbore, or in a deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first," "second," "third," and the like may also be used to differentiate between identical components or between components which are similar in use, structure, or operation. Such language is not intended to limit a component to a singular designation. As such, a component referenced in the specification as the "first" component may be the same or different than a component that is referenced in the claims as a "first" component.

Furthermore, while the description or claims may refer to "an additional" or "other" element, feature, aspect, component, or the like, it does not preclude there being a single element, or more than one, of the additional element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral" or "integrally" formed include components made from the same piece of material, or sets of materials, such as by being commonly molded or cast from the same material, or commonly machined from the same piece of material stock. Components that are "integral" should also be understood to be "coupled" together.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

While embodiments disclosed herein may be used in oil, gas, or other hydrocarbon exploration or production environments, such environments are merely illustrative. Systems, tools, assemblies, methods, casing-while-drilling systems, liner-while-drilling systems, activation systems, and other components of the present disclosure, or which would be appreciated in view of the disclosure herein, may be used in other applications and environments. In other embodiments, downhole tools, methods for activating a downhole tool, methods for circulating within a wellbore, or other embodiments discussed herein, or which would be appreciated in view of the disclosure herein, may be used outside of a downhole environment, including in connection with other systems, including within automotive, aquatic, aerospace, hydroelectric, manufacturing, other industries, or even in other downhole environments. The terms "well," "wellbore," "borehole," and the like are therefore also not intended to limit embodiments of the present disclosure to a particular industry. A wellbore or borehole may, for instance, be used for oil and gas production and exploration, water production and exploration, mining, utility line placement, or myriad other applications.

Certain embodiments and features may have been described using a set of numerical values that may provide lower and upper limits. It should be appreciated that ranges including the combination of any two values are contemplated unless otherwise indicated, and that a particular value may be defined by a range having the same lower and upper limit. Any numbers, percentages, ratios, measurements, or other values stated herein are intended to include the stated value as well as other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least experimental error and variations that would be expected by a person having ordinary skill in the art, as well as the variation to be expected in a suitable manufacturing or production process. A value that is about or approximately the stated value and is therefore encompassed by the stated value may further include values that are within 5%, within 1%, within 0.1%, or within 0.01% of a stated value.

The abstract in this disclosure is provided to allow the reader to quickly ascertain the general nature of some embodiments of the present disclosure. It is submitted with the understanding that it will not be used to interpret or limit the scope or meaning of the claims.

What is claimed is:

1. A flow control tool, comprising:

a tool body having a central bore extending therethrough and at least one bypass port configured to allow a fluid flow to pass radially out of the tool body from the central bore;

a control sleeve at least partially within the central bore, the control sleeve being configured to restrict the fluid flow from passing through the at least one bypass port when the control sleeve is in an inactive state and to allow the fluid flow to pass through the at least one bypass port when the control sleeve is in an active state; and a release subassembly movably coupled to the tool body and including an outer sleeve coupled to at least one packoff device, the outer sleeve and at least one packoff device configured to move axially relative to the tool body to transition the release subassembly between an open state and a closed state, the outer sleeve and the at least one packoff device configured to control passage of fluid along an outer surface of the tool body such that:

in the open state, fluid flow in at least one flow passage extending along the outer surface of the tool body and inside the at least one packoff device is permitted; and in the closed state, fluid flow in the at least one flow passage extending along the outer surface of the tool body and inside the at least one packoff device is restricted.

2. The flow control tool of claim 1, the control sleeve being configured to transition from the inactive state to the active state in response to an activation mechanism and by moving to align at least one flow port of the control sleeve with the at least one bypass port.

3. The flow control tool of claim 2, the activation mechanism including a ball configured to be dropped through the central bore to block the fluid flow from passing through the control sleeve.

4. The flow control tool of claim 1, the tool body including an upper sub and a lower sub, the control sleeve being axially moveable within the lower sub.

5. The flow control tool of claim 1, further comprising:

at least one shear element coupling the tool body to the control sleeve when the control sleeve is in the inactive state, the control sleeve being configured to move and transition to the active state upon failure of the at least one shear screw.

6. The flow control tool of claim 1, the outer sleeve being threadably coupled to the tool body.

7. The flow control tool of claim 1, the tool body being configured to be rotated to reposition the at least one packoff device.

8. The flow control tool of claim 1, the at least one flow passage including a plurality of axially and circumferentially extending flow passages formed in the outer surface of the tool body.

9. The flow control tool of claim 8, further comprising:

an unloader seal coupled to the tool body, a seal being formed between the unloader seal and the at least one packoff device to restrict fluid flow through the flow passages.

10. The flow control tool of claim 1, further comprising:

one or more locking pins coupled to the tool body and engaged with the control sleeve, the locking pins being configured to restrict axial movement of the release subassembly when the control sleeve is in the inactive state.

11. The flow control tool of claim 10, the control sleeve including at least one extended feature and at least one recessed feature that control radial movement of the one or more locking pins.

12. A casing-while-drilling system, comprising:

a liner;

a bottomhole assembly below the liner, the bottomhole assembly including a drill bit and an underreamer; and a drilling flow control tool coupled to the liner and including:

a tool body with a central bore and at least one bypass port configured to allow a fluid flow to pass radially from the central bore to an outer diameter of the tool body;

a control sleeve within the central bore, the control sleeve being configured to restrict the fluid flow from passing through the at least one bypass port when in an inactive state and to allow the fluid flow to pass through the at least one bypass port when in an active state; and a release subassembly including an outer sleeve and at least one packer cup movably coupled to the tool body, the release subassembly being configured to move between an open state and a closed state, the outer sleeve and the at least one packer cup configured to control passage of fluid along the outer diameter of the tool body, the at outer sleeve and the least one packer cup being further configured to allow fluid flow through at least one flow passage at the outer diameter of the tool body when the release assembly is in the open state, and to restrict fluid flow through the at least one flow passage when the release assembly is in the closed state.

13. The casing-while-drilling system of claim 12, the plurality of flow passages being formed as axially and circumferentially extending grooves in the outer surface of the tool body.

14. The casing-while-drilling system of claim 12, the drilling flow control tool being configured to circulate the fluid flow in an outer annulus between an outer diameter of the liner and an inner diameter of a wellbore when the control sleeve is in the active state and the release subassembly is in the closed state.

15. The casing-while-drilling system of claim 14, the drilling flow control tool being configured to circulate cement from the central bore to the outer annulus when the control sleeve is in the active state and the release subassembly is in the closed state.

16. The casing-while-drilling system of claim 12, the drilling flow control tool being configured to circulate the fluid flow in an inner annulus between an inner diameter of the liner and the outer diameter of the tool body when the control sleeve is in the active state and the release subassembly is in the open state.

17. The casing-while-drilling system of claim 12, the bottomhole assembly being configured to be retrievable through the liner when the control sleeve is in the active state and the release subassembly is in the open state.

18. The casing-while-drilling system of claim 12, the control sleeve being configured to transition from the inactive state to the active state by moving to align at least one flow port of the control sleeve with the at least one bypass port.

19. A method, comprising:

tripping a drill string into a wellbore, the drill string including a flow control tool within a liner, the flow control tool including:

a tool body having a central bore, at least one bypass port configured to allow fluid flow to pass radially outwardly from the central bore to an outer diameter of the tool body, and at least one flow passage extending axially along the outer diameter of the tool body;

a control sleeve coupled to the tool body, the control sleeve being in an inactive state and configured to restrict fluid flow through the at least one bypass port; and a release subassembly movably coupled to the tool body and positioned in an open state in which at least one packoff device of the release subassembly allows fluid flow through the at least one flow passage;

transitioning the control sleeve from the inactive state to the active state and thereby allowing the fluid flow through the at least one bypass port;

circulating the fluid flow in an inner annulus between an inner diameter of the liner and the outer diameter of the tool body when the control sleeve is in the active state and the release subassembly is in the open state;

rotating the tool body, wherein rotating the tool body causes the at least one packoff device to be repositioned and transition the release subassembly from the open state to a closed state restricting the fluid flow through the at least one flow passage; and circulating the fluid flow in an outer annulus between an outer diameter of the liner and an inner diameter of the wellbore when the control sleeve is in the active state and the release subassembly is in the closed state.

* * * * *